US005186011A

United States Patent [19]

Yoshida et al.

[11] Patent Number: 5,186,011

[45] Date of Patent: Feb. 16, 1993

[54] REFRIGERANT CYCLING APPARATUS

[75] Inventors: Yuji Yoshida, Itami; Minoru Tagashira, Hirakata; Kazuo Nakatani, Kadoma; Masami Funakura, Hirakata, all of Japan

[73] Assignee: Matsushita Electric Industrial Co., Ltd., Osaka, Japan

[21] Appl. No.: 836,430

[22] Filed: Feb. 18, 1992

[30] Foreign Application Priority Data

Feb. 18, 1991 [JP] Japan ..... 3-023197
Feb. 18, 1991 [JP] Japan ..... 3-023199

[51] Int. Cl.[5] ..... F25B 7/00

[52] U.S. Cl. ..... 62/114; 62/149; 62/502

[58] Field of Search ..... 62/149, 114, 502, 113, 62/267, 324.6, 335

[56] References Cited

U.S. PATENT DOCUMENTS

| | | | |
|---|---|---|---|
| 4,325,231 | 4/1982 | Krieger | 62/335 |
| 4,722,195 | 2/1988 | Suzuki et al. | 62/149 |
| 4,913,714 | 4/1990 | Ogura et al. | 62/149 |
| 4,972,676 | 11/1990 | Sakai | 62/18 |
| 5,012,651 | 5/1991 | Nakatani et al. | 62/149 |

FOREIGN PATENT DOCUMENTS

| | | |
|---|---|---|
| 0377329A3 | 12/1989 | European Pat. Off. . |
| 63-279062 | 11/1988 | Japan . |
| WO86/01881 | 9/1985 | PCT Int'l Appl. . |

*Primary Examiner*—Albert J. Makay

*Assistant Examiner*—William C. Doerrler

*Attorney, Agent, or Firm*—Wenderoth, Lind & Ponack

[57] ABSTRACT

A refrigerant cycling apparatus, enclosing a non-azeotropic mixture including a low-boiling point refrigerant and a low-boiling point refrigerant, includes: a first compressor; a second compressor, a suction pipe of which is connected with a discharge pipe of the first compressor; a fractionating/separating device, the discharge pipe of the first compressor being connected with one of a top portion and a middle portion of the fractionating/separating device, the suction pipe of the first compressor being connected with the top portion of the fractionating/separating device, the discharge pipe of the second compressor being connected with one of the middle portion and a bottom portion of the fractionating/separating device, the suction pipe of the second compressor being connected with the bottom portion of the fractionating/separating device; a first pressure reducing device provided between the top portion of the fractionating/separating device and the suction pipe of the first compressor; a first vaporizing device provided between the first pressure reducing device and the suction pipe of the first compressor to vaporize the refrigerant; a second pressure reducing device provided between the discharge pipe of the second compressor and the fractionating/separating device; and a first condensing device provided between the second pressure reducing device and the suction pipe of the second compressor to condense the refrigerant.

9 Claims, 2 Drawing Sheets

REFRIGERANT CYCLING APPARATUS

BACKGROUND OF THE INVENTION

The present invention relates to the improvement of a refrigerant cycling apparatus for use in an air-conditioner for obtaining a high or low temperature.

A conventional refrigerant cycling apparatus for obtaining a high or a low temperature has a plurality of refrigerant cycling devices are connected with each other in cascade type. In this refrigerant cycling apparatus, a high-boiling refrigerating component is enclosed in a cycle positioned in a higher stage and a low-boiling refrigerating component is enclosed in a cycle positioned in a lower stage. Further, a heat exchanger is provided to perform a heat exchange between the evaporated refrigerant in the higher stage and the condensed refrigerant in the lower stage.

In this apparatus, since the high-boiling point refrigerant is enclosed in the higher stage cycle, a high temperature is obtained with the vapor pressure lowered in the condenser in the higher stage. Since the low-boiling point refrigerant is enclosed in the lower stage cycle, a low temperature is obtained in the evaporator in the lower stage without generating a negative pressure.

The above-described conventional apparatus is suitable for obtaining a higher temperature or a lower temperature. But the heat exchange between the evaporated refrigerant in the higher stage and the condensed refrigerant in the lower stage is performed to reliably separate the high-boiling point refrigerant enclosed in the higher stage cycle and the low-boiling point refrigerant enclosed in the lower stage cycle from each other. Therefore, the evaporation temperature of the refrigerant in the higher stage is lower than the condensation temperature of the refrigerant in the lower stage. Therefore, compressors provided in the higher and the lower stage cycles are operated with a large compression ratio. Hence, the conventional apparatus is operated with a low efficiency.

In recent years, there is a growing demand for the development of a refrigerant cycling apparatus capable of supplying hot water and air-conditioning the temperature of a room rather than an apparatus just for supplying hot water or an extremely low temperature. However, in the conventional apparatus comprising a plurality of refrigerant cycling devices, the condenser in the higher stage is capable of serving as a means for supplying hot water as well as a heater, however, the apparatus is large-sized because a high-boiling point refrigerant has a low heating performance.

SUMMARY OF THE INVENTION

Accordingly, it is an object of the present invention to provide a refrigerant cycling apparatus capable of separating a non-azeotropic mixture of refrigerants into a high-boiling point refrigerant circulating through one cycle and a low-boiling point refrigerant circulating through the other cycle without the need for the provision of a heat exchanger in an intermediate portion and allowing a condensing means to provide a high temperature and an evaporating means to provide a low temperature while the apparatus is being operated with a high efficiency.

It is another object of the present invention to provide a refrigerant cycling apparatus capable of controlling the composition ratio of components of a non-azeotropic mixture of refrigerants by separating and mixing with each other a high-boiling point refrigerant circulating through one cycle and a low-boiling point refrigerant circulating through the other cycle so that a high-stage condensing means in which the high-boiling point refrigerant circulates increases heating performance.

In accomplishing these and other objects, according to one aspect of the present invention, there is provided a refrigerant cycling apparatus, enclosing a non-azeotropic mixture comprising a low-boiling point refrigerant and a low-boiling point refrigerant, comprising:

a first compressor;

a second compressor, a suction pipe of which is connected with a discharge pipe of the first compressor;

a fractionating/separating device, the discharge pipe of the first compressor being connected with one of a top portion and a middle portion of the fractionating-/separating device, the suction pipe of the first compressor being connected with the top portion of the fractionating/separating device, the discharge pipe of the second compressor being connected with one of the middle portion and a bottom portion of the fractionating/separating device, the suction pipe of the second compressor being connected with the bottom portion of the fractionating/separating device;

a first pressure reducing device provided between the top portion of the fractionating/separating device and the suction pipe of the first compressor;

a first vaporizing means provided between the first pressure reducing device and the suction pipe of the first compressor to vaporize the refrigerant;

a second pressure reducing device provided between the discharge pipe of the second compressor and the fractionating/separating device; and a first condensing means provided between the second pressure reducing device and the suction pipe of the second compressor to condense the refrigerant.

According to the apparatus of the above construction, the non-azeotropic mixture of refrigerants is separated into the low-boiling point refrigerant and the high-boiling point refrigerant in the fractionating-/separating device due to the contact of the refrigerant supplied from the discharge pipe of the first compressor to the top or middle portion of the fractionating-/separating device and the refrigerant supplied from the discharge pipe of the second compressor to the bottom or middle portion of the fractionating/separating device via the condenser and the second pressure reducing device. Consequently, the low-boiling point refrigerant is concentrated in the upper portion of the fractionating/separating device and the high-boiling point refrigerant is concentrated in the lower portion thereof. Thus, the concentrated low-boiling point refrigerant circulates in a first refrigerating cycle comprising the first pressure reducing device connected with the top portion of the fractionating/separating device, the first evaporating means, the first compressor, and the discharge pipe of the first compressor connected with the top or middle portion of the fractionating/separating device. Since the bottom portion of the fractionating-/separating device at which the high-boiling point refrigerant is concentrated is connected with the suction pipe of the second compressor, the concentrated high-boiling point refrigerant circulates in a second refrigerating cycle comprising the second compressor, the first condensing means, the second pressure reducing device, and the pipe connecting the second pressure reducing device and the bottom or middle portion of the fractionating/separating device.

Further, although a heat exchanger is previously required to be provided in the intermediate portion like the conventional refrigerant cycling apparatus comprising a plurality of refrigerant cycling devices, the heat exchanger is not required in the present invention. The refrigerant can be separated into the low-boiling point refrigerant circulating through the first refrigerating cycle and the high-boiling point refrigerant circulating through the second refrigerating cycle. In addition, since the two compressors can be operated at a small compression ratio, a high temperature can be obtained in the first condensing means and a low temperature can be provided in the first evaporating means with a highly efficient operation.

According to another aspect of the present invention, there is provided the refrigerant cycling apparatus as described above, wherein the bottom portion of the fractionating/separating device is connected with the suction pipe of the second compressor on the downstream side of a confluence point of the discharge pipe of the first compressor where the discharge pipe of the first compressor is connected with the fractionating-/separating device.

According to one modification of the present invention, there is provided the refrigerant cycling apparatus as described above, further comprising:

a second vaporizing means provided between the discharge pipe of the first compressor and the fractionating/separating device to vaporize the refrigerant;

a second condensing means provided between the suction pipe of the second compressor and the fractionating/separating device to condense the refrigerant; and a third condensing means provided between the top portion of the fractionating/separating device and the first pressure reducing device to condense the refrigerant.

According to the apparatus of the above construction, the non-azeotropic mixture of refrigerants is separated into the low-boiling point refrigerant and the high-boiling point refrigerant in the fractionating-/separating device. Consequently the low-boiling point refrigerant is concentrated in the upper portion of the fractionating/separating device and the high-boiling point refrigerant is concentrated in the lower portion thereof. Thus, the concentrated low-boiling point refrigerant circulates through a first refrigerating cycle comprising the first pressure reducing device connected with the top portion of the fractionating/separating device, the evaporating means, the first compressor, and the discharge pipe of the first compressor connected with fractionating/separating device. The second vaporizing means in which the concentrated high-boiling point refrigerant is stored is connected with the discharge pipe of the first compressor on the downstream side of the bypassing pipe of the first compressor through the pipe. Therefore, the high-boiling point liquid refrigerant fed from the second vaporizing means is introduced into the second compressor at a lower temperature because it is mixed with the low-boiling point gas refrigerant fed from the first compressor through the discharge pipe. Thus, a non-azeotropic mixture of refrigerants consisting of components, the boiling points of many of which are higher than those of the refrigerant circulating through the first refrigerating cycle circulates through a second refrigerating cycle comprising the discharge pipe, the condensing means, the second pressure reducing device, and the fractionating/separating device. The separation of the non-azeotropic refrigerant thus obtained occurs repeatedly inside the fractionating/separating device. As a result, the low-boiling point refrigerant is concentrated in the top portion of the fractionating/separating device and the high-boiling point refrigerant is concentrated in the bottom portion thereof. The circuit bypassing the discharge pipe of the first compressor and connected with the top portion of the fractionating/separating device may be shut off and in addition, the circuit connecting the bottom portion of the fractionating/separating device and the second compressor with each other on the downstream side of the discharge pipe of the first compressor may be shut off. Consequently, in the fractionating/separating device, the separation of the non-azeotropic mixture of refrigerants enclosed in the apparatus is stopped. As a result, the non-azeotropic mixture of refrigerants enclosed in the apparatus circulates through the first compressor, the second compressor, the condensing means, the second pressure reducing device, the fractionating/separating device, the first pressure reducing device connected with the top portion of the fractionating/separation device, and the evaporating means. Thus, the unseparated non-azeotropic mixture of refrigerants consists of components, the boiling points of many of which are lower than those of components of the separated non-azeotropic mixture of refrigerants. Therefore, in this case, the non-azeotropic mixture of refrigerants is condensed by the condensing means at a lower boiling point. That is, the apparatus has a high heating performance.

According to another aspect of the present invention, there is provided the refrigerant cycling apparatus as described above, wherein an outlet pipe of the first condensing means is bypassed so that the first condensing means is connected with a line connected between the first pressure reducing device and the first vaporizing means through a main pressure reducing means.

According to one modification of the present invention, there is provided the refrigerant cycling apparatus as described above, further comprising:

a second vaporizing means provided between the discharge pipe of the first compressor and the fractionating/separating device to vaporize the refrigerant;

a second condensing means provided between the suction pipe of the second compressor and the fractionating/separating device to condense the refrigerant; and a third condensing means provided between the top portion of the fractionating/separating device and the first pressure reducing device to condense the refrigerant.

According to the apparatus of the above construction, the non-azeotropic mixture of refrigerants is separated into the low-boiling point refrigerant and the high-boiling point refrigerant in the fractionating-/separating device. Consequently, the low-boiling point refrigerant is concentrated in the upper portion of the fractionating/separating device and the high-boiling point refrigerant is concentrated in the lower portion thereof. Accordingly, the second compressor connected with the bottom portion of the fractionating-/separating device sucks the gas refrigerant at a low temperature. Concentrated high-boiling point refrigerant circulates through a second refrigerating cycle comprising the second compressor, the condenser, the second pressure reducing device, and the bottom portion of the fractionating/separating device and through a circuit comprising the outlet pipe of the condenser terminating at the confluence point of the outlet pipe of the main pressure reducing device and the outlet pipe of the first pressure reducing device. The top portion of the fractionating/separating device at which the low-boiling refrigerant is concentrated is connected with the outlet pipe of the main pressure reducing device via the first pressure reducing device. Therefore, the low-boiling point refrigerant discharged from the fractionating-/separating device and fed through the pipe mixes with the high-boiling point refrigerant discharged from the main pressure reducing device and fed through the outlet pipe. As a result, a non-azeotropic mixture of refrigerants consisting of components, the boiling points of many of which are lower than those of the refrigerant circulating through the second refrigerating cycle circulates through the first refrigerating cycle comprising the evaporating means, the first compressor, and the fractionating/separating device. The separation of the non-azeotropic mixture of refrigerants thus obtained occurs repeatedly in the fractionating/separating device. As a result, the low-boiling point refrigerant is concentrated in the top portion of the fractionating-/separating device and the high-boiling point refrigerant is concentrated in the bottom portion thereof. The first pressure reducing device or the second pressure reducing device may be shut off in a circuit bypassing the outlet pipe of the condenser and connected with the bottom portion of the fractionating/separating device via the second pressure reducing device and a circuit connecting the top portion of the fractionating/separating device and the outlet pipe of the main pressure reducing device with each other via the first pressure reducing device. Consequently, the separation of the non-azeotropic mixture of refrigerants enclosed in the apparatus is stopped. As a result, the non-azeotropic mixture of refrigerants enclosed in the apparatus circulates through the first compressor, the fractionating-/separating device, the second compressor connected with the bottom portion of the fractionating/separating device. the condenser, the main pressure reducing device, and the evaporating means. Thus, the unseparated non-azeotropic mixture of refrigerants consists of components, the boiling points of many of which are lower than those of components of the separated non-azeotropic mixture of refrigerants. Therefore, in this case, the non-azeotropic mixture of refrigerants is condensed by the condenser at a lower boiling point. That is, the apparatus has a high heating performance.

Therefore, although a heat exchanger is previously required to be provided in the intermediate portion like the conventional refrigerant cycling apparatus comprising a plurality of refrigerant cycling devices, the heat exchanger is not required in the present invention. The refrigerant can be separated into the low-boiling point refrigerant circulating through the first refrigerating cycle and the high-boiling point refrigerant circulating through the second refrigerating cycle. The two compressors can be operated at a small compression ratio with the refrigerant introduced into the second compressor and discharged therefrom at a low temperature. Therefore, a high temperature can be obtained in the condenser and a low temperature can be provided in the evaporating means at a highly efficient operation. The component of the separated refrigerant and the vapor pressure in the condenser produced after the separation is made are selected by the combination and proportion of the components of the non-azeotropic mixture of refrigerants enclosed in the apparatus and the set pressure of each pressure reducing device.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Referring now to the accompanied drawings, the embodiments of the present invention will be described in detail below.

First Embodiment

Figure 1:
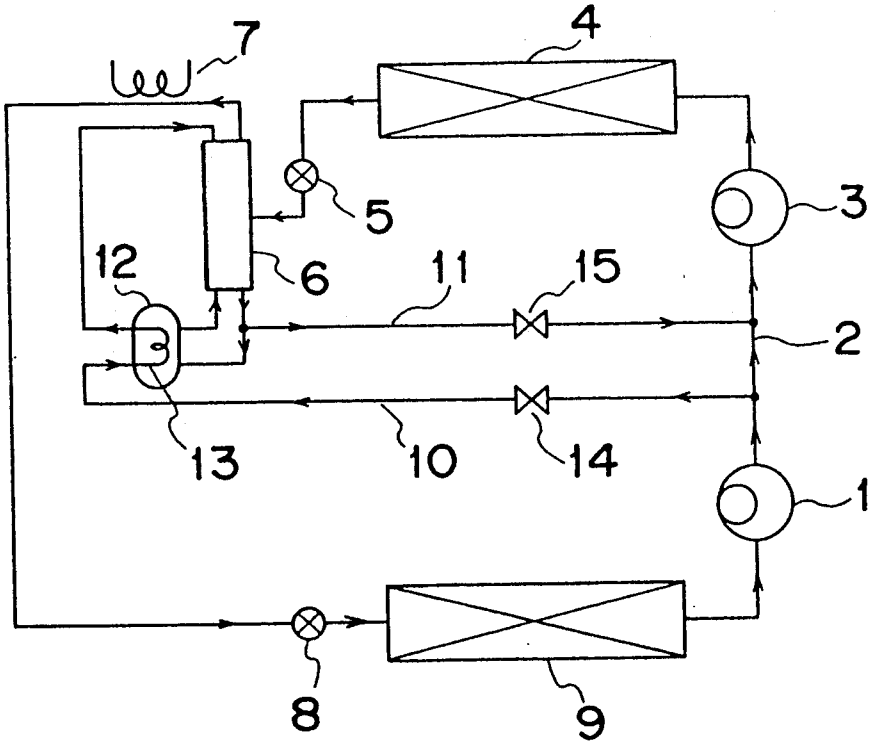
FIG. 1 is a block diagram of a refrigerant cycling apparatus according to a first embodiment of the present invention.

A first embodiment of the present invention is described with reference to FIG. 1. A refrigerant cycling apparatus of the embodiment comprises a first compressor 1; a discharge pipe 2 of the first compressor 1; a second compressor 3, the inlet pipe of which is connected with the discharge pipe 2 of the first compressor 1; a condenser 4; a second pressure reducing device 5: a fractionating/separating device 6, a middle portion of which is connected with the outlet pipe of the second pressure reducing device 5; a cooling device 7 for aiding the condensation of refrigerant discharged from the top portion of the fractionating/separating device 6; a first pressure reducing device 8 connected with the top portion of the fractionating/separating device 6; an evaporator 9, the outlet pipe of which is connected with the suction pipe of the first compressor 1. The inlet pipe of the evaporator 9 is connected with the top portion of the fractionating/separating device 6 through the first pressure reducing device 8. The discharge pipe of the second compressor 3 is connected with the middle portion of the fractionating/separating device 6 through the condenser 4 and the second pressure reducing device 5. The cooling source of the cooling device 7 comprises a pipe extending from the evaporator 9. A pipe 10 bypassing the discharge pipe 2 of the first compressor 1 is connected with the top portion of the fractionating-/separating device 6. The bottom portion of the fractionating/separating device 6 is connected with the discharge pipe 2 of the first compressor 1 on the downstream side of the pipe 10 of the first compressor 1 through a pipe 11 and therefore, connected with the second compressor 3. A reservoir 12 is provided below the bottom portion of the fractionating/separating device 6. A circulation circuit is provided below the bottom portion of the fractionating/separating device 6 through the reservoir 12. The pipe 10 of the first compressor 1 is connected with the top portion of the fractionating/separating device 6 via a heat exchanger 13, which is used for the fractionating/separating device 6. provided inside the reservoir 12. Electromagnetic valves 14 and 15 are provided in the pipe 10 of the first compressor 1 and in the pipe 11 connected with the bottom portion of the fractionating/separating device 6, respectively. The apparatus encloses a non-azeotropic mixture of refrigerants consisting of a low-boiling point refrigerant and a high-boiling point refrigerant.

In this refrigerant cycling apparatus, two-phase refrigerant is supplied from the second compressor 3 to the middle portion of the fractionating/separating device 6 through the condenser 4 and the outlet pipe of the second pressure reducing device 5. Gas refrigerant supplied from the pipe 10 of the first compressor 1 is liquefied through the heat exchanger 13 provided inside the reservoir 12 and the liquefied refrigerant thus obtained is supplied to the top portion of the fractionating-/separating device 6. At this time, the gas refrigerant supplied from the pipe 10 is heated and evaporated through the heat exchanger 13 and stored in the reservoir 12 provided below the bottom portion of the fractionating/separating device 6. A rectification action takes place in the fractionating/separating device 6 due to the contact of the falling liquid refrigerant and the rising gas refrigerant through the surface of a filler (not shown) charged therein. Thus, the non-azeotropic mixture of refrigerants is separated into low-boiling refrigerant and high-boiling point refrigerant. That is, the low-boiling refrigerant is concentrated in the top portion of the fractionating/separating device 6 and the high-boiling point refrigerant is concentrated in the bottom portion thereof. Accordingly, concentrated low-boiling point refrigerant circulates through a first refrigerating cycle comprising the cooling device 7 for aiding the condensation of the refrigerant discharged from the top portion of the fractionating/separating device 6: the first pressure reducing device 8 connected with the top portion of the fractionating/separating device 6; the evaporator 9, the first compressor 1; and the pipe 10 bypassing the discharge pipe 2 of the first compressor 1 and connected with the top portion of the fractionating/separating device 6. The reservoir 12 in which the concentrated high-boiling point refrigerant is stored is connected with the discharge pipe 2 of the first compressor 1 on the downstream side of the pipe 10 bypassing the discharge pipe 2 of the first compressor 1 through the pipe 11. Therefore, the high-boiling point liquid refrigerant fed from the reservoir 12 is introduced into the second compressor 3 at a lower temperature because the high-boiling point liquid refrigerant is mixed with the low-boiling point gas refrigerant fed from the first compressor 1 through the discharge pipe 2 thereof. Thus, a non-azeotropic mixture of refrigerants consisting of components, the boiling points of many of which are higher than those of the refrigerant circulating through the first refrigerating cycle circulates through a second refrigerating cycle comprising the second compressor; the condenser 4 the second pressure reducing device 5; and the fractionating-/separating device 6. The separation of the non-azeotropic refrigerant thus obtained occurs repeatedly inside the fractionating/separating device 6. As a result, the low-boiling point refrigerant is concentrated in the top portion of the fractionating/separating device 6 and the high-boiling point refrigerant is concentrated in the bottom portion thereof.

The following control of the components of the non-azeotropic mixture of refrigerants can be made. That is, in the fractionating/separating device 6, the separation of the non-azeotropic mixture of refrigerants enclosed in the apparatus is stopped by the shut-off of the electromagnetic valve 14 provided in the pipe 10 bypassing the discharge pipe 2 of the first compressor 1 and the shut-off of the electromagnetic valve 15 provided in the pipe 11 connected with the bottom portion of the fractionating/separating device 6. As a result, the non-azeotropic mixture of refrigerants enclosed in the apparatus circulates through the first compressor 1, the discharge pipe 2, the second compressor 3 the condenser 4, the second pressure reducing device 5, the fractionating-/separating device 6 the cooling device 7, the first pressure reducing device 8 connected with the top portion of the fractionating/separating device 6, and the evaporator 9. Thus, the unseparated non-azeotropic mixture of refrigerants consists of components, the boiling points of many of which are lower than those of components of the separated non-azeotropic mixture of refrigerants. Therefore, in this case, the non-azeotropic mixture of refrigerants is condensed by the condenser 4 at a lower boiling point. That is, the apparatus has a higher heating performance.

In the first embodiment, the outlet pipe of the second pressure reducing device 5 is connected with the fractionating/separating device 6 at the middle portion thereof, however, may be connected therewith at any position between the top portion and the bottom portion thereof. In addition, it is possible to vary the throttling degree of the second pressure reducing device 5 and that of the first pressure reducing device 8. Furthermore, any means may be used as the cooling source of the cooling device 7 and the heating source of the heat exchanger 13 provided that the means accelerates the separation of the azeotropic mixture of refrigerants into the low-boiling point refrigerant and the high-boiling point refrigerant by means of the two-phase refrigerant supplied from the second pressure reducing device 5. The above description is made on the principle of the refrigerant cycling apparatus which performs the above operation. Needless to say, the apparatus can be applied as a means for air conditioning or supplying hot water or a means for providing an extremely low temperature.

As described above, although a heat exchanger is previously required to be provided in the intermediate portion like the conventional refrigerant cycling apparatus comprising a plurality of refrigerant cycling devices, the heat exchanger is not required in the first embodiment. The refrigerant can be separated into the low-boiling point refrigerant circulating through the first refrigerating cycle and the non-azeotropic mixture of refrigerants circulating through the second refrigerating cycle. The non-azeotropic mixture of refrigerants circulating through the second refrigerating cycle consists of components, the boiling points of many of which are higher than those of the refrigerant circulating through the first refrigerating cycle. The discharge pressure of the first compressor 1 and the suction pressure of the second compressor 3 are approximately equal to each other with the non-azeotropic mixture of refrigerants introduced into the second compressor 3 and discharged therefrom at a low temperature. Thus, the apparatus is operated at a high efficiency with the compression ratios of the first compressor 1 and the second compressor 3 reduced. Therefore, a high temperature can be provided by making the vapor pressure low in the condenser 4 positioned in the second refrigerating cycle and a low temperature can be provided without producing a negative pressure in the evaporator 9 positioned in the first refrigerating cycle. The component of the separated refrigerant and the vapor pressure in the condenser 4 produced after the separation is made are selected by the combination and proportion of the components of the non-azeotropic mixture of refrigerants enclosed in the apparatus and the set pressure of the first pressure reducing device 5 and the set pressure of the second pressure reducing device 8. The refrigerating cycle of the apparatus is constructed so that the pressure necessary for the separation of the non-azeotropic mixture of refrigerants into the low-boiling point refrigerant and the high-boiling point refrigerant in the fractionating/separating device 6 is approximately equal to the discharge pressure of the first compressor 1 as well as the suction pressure of the second compressor 3. Thus, the above-described advantage of the first embodiment can be obtained.

Second Embodiment

Figure 2:
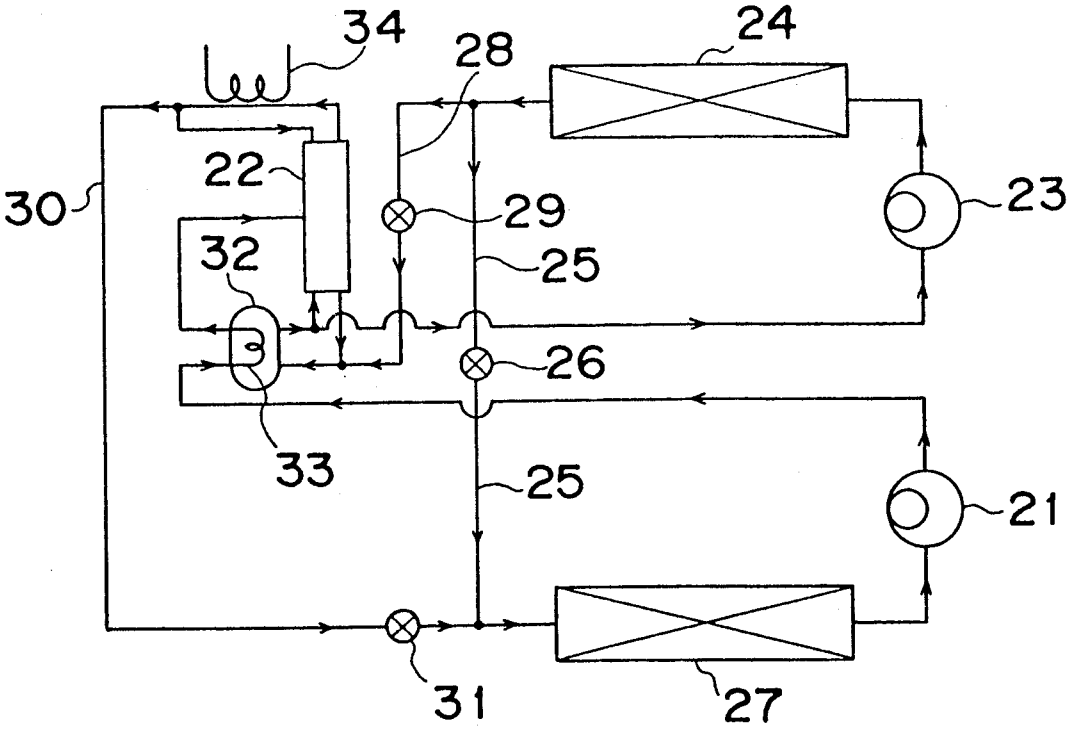
FIG. 2 is a block diagram of a refrigerant cycling apparatus according to a second embodiment of the present invention.

The detailed construction of a refrigerant cycling apparatus of a second embodiment is described below with reference to FIG. 2. The refrigerant cycling apparatus of the second embodiment comprises a first compressor 21; a fractionating/separating device 22, a middle portion of which is connected with the discharge pipe of the first compressor 21: a second compressor 23 connected with the bottom portion of the fractionating-/separating device 22; a condenser 24 provided in the pipe between the second compressor 23 and the bottom portion of the fractionating/separating device 22; an outlet pipe 25 of the condenser 24; a main pressure reducing device 26 provided in the outlet pipe 25 of the condenser 24; an evaporator 27, the outlet pipe of which is connected with the suction pipe of the first compressor 21. An outlet pipe 28 bypassing the outlet pipe 25 of the condenser 24 is connected with the bottom portion of the fractionating/separating device 22 via a second pressure reducing device 29. A pipe 30 connects the top portion of the fractionating/separating device 22 with the outlet pipe 25 of the main pressure reducing device 26 via a first pressure reducing device 31. Therefore, the fractionating/separating device 22 is connected with the evaporator 27 and the first compressor 21. A reservoir 32 is provided below the bottom portion of the fractionating/separating device 22. A circulation circuit is provided below the bottom portion of the fractionating/separating device 22 through the reservoir 32. The discharge pipe of the first compressor 21 is connected with the middle portion of the fractionating-/separating device 22 via a heat exchanger 33, which is used for the fractionating/separating device 22, provided inside the reservoir 32. A circulation circuit provided above the top portion of the fractionating-/separating device 22 accommodates a cooling device 34 along the pipe 30. The cooling source of the cooling device 34 comprises the outlet pipe of the evaporator 27. A second pressure reducing device 29 positioned in the bypassed outlet pipe 28 of the condenser 24 and the first pressure reducing device 31 positioned in the pipe 30 connected with the top portion of the fractionating-/separating device 22 comprise an expansion valve, respectively which can be shut off. The apparatus encloses a non-azeotropic mixture of refrigerants consisting of a low boiling point refrigerant and a high-boiling point refrigerant. The outlet pipe of the reservoir 32 connected with the bottom portion of the fractionating-/separating device 22 is also connected with the suction pipe of the second compressor 23.

In this refrigerant cycling apparatus, a rectification action takes place in the fractionating/separating device 22 due to the contact of two-phase refrigerant, gas refrigerant, and liquid refrigerant through the surface of a filler (not shown) charged therein. The two-phase refrigerant is formed by the partial liquefaction of gas refrigerant supplied from the discharge pipe of the first compressor 21 through the heat exchanger 33 provided inside the reservoir 32. The gas refrigerant stored in the reservoir 32 provided below the fractionating/separating device 22 is heated and liquefied through the heat exchanger 33. The gas refrigerant discharged from the fractionating/separating device 22 is liquefied by the cooling device 34 in the circulation circuit provided above the top portion of the fractionating/separating device 22. Thus, the liquid refrigerant is formed and returns to the top portion of the fractionating/separating device 22. In this manner, the non-azeotropic mixture of refrigerants is separated into low-boiling refrigerant and high-boiling point refrigerant. The low-boiling refrigerant is concentrated in the top portion of the fractionating/separating device 22 and the high-boiling point refrigerant is concentrated in the bottom portion thereof. The second compressor 23 connected with the bottom portion of the fractionating/separating device 22 sucks the gas refrigerant at a low temperature because the second compressor 23 sucks saturated gas refrigerant mostly. Concentrated high boiling point refrigerant circulates through a second refrigerating cycle comprising the second compressor 23, the condenser 24, the bypassed outlet pipe 28 of the condenser 24, the second pressure reducing device 29, and the bottom portion of the fractionating/separating device 22 and through a circuit comprising the outlet pipe 25 of the condenser 24 terminating at the confluence point of the outlet pipe 25 of the main pressure reducing device 26 and the outlet pipe of the first pressure reducing device 31. The pipe 30 connects the top portion of the fractionating/separating device 22 at which the low-boiling refrigerant is concentrated to the outlet pipe 25 of the main pressure reducing device 26 via the first pressure reducing device 31. Therefore, the low-boiling point refrigerant discharged from the fractionating-/separating device 22 and fed through the pipe 30 mixes with the high-boiling point refrigerant discharged from the main pressure reducing device 26 and fed through the outlet pipe 25. As a result, a non-azeotropic mixture of refrigerants consisting of components, the boiling points of many of which are lower than those of the refrigerant circulating through the second refrigerating cycle, circulates through the first refrigerating cycle comprising the evaporator 27, the first compressor 21, and the fractionating/separating device 22. The separation of the non-azeotropic mixture of refrigerants thus obtained occurs repeatedly in the fractionating/separating device 22. As a result, the low-boiling point refrigerant is concentrated in the top portion of the fractionating/separating device 22 and the high-boiling point refrigerant is concentrated in the bottom portion thereof.

The following control of the components of the non-azeotropic mixture of refrigerants can be made. That is, in the fractionating/separating device 6, the separation of the non-azeotropic mixture of refrigerants enclosed in the apparatus is stopped by the shut-off of the second pressure reducing device 29 positioned in the bypassing pipe 28 of the condenser 24 and the shut-off of the first pressure reducing device 31 positioned in the pipe 30 connected with the top portion of the fractionating-/separating device 22. As a result, the non azeotropic mixture of refrigerants enclosed in the apparatus circulates through the first compressor 21, the heat exchanger 33, the fractionating/separating device 22, the second compressor 23 connected with the bottom portion of the fractionating/separating device 22, the condenser 24, the outlet pipe 25 of the condenser 24, the main pressure reducing device 26, and the evaporator 27. Thus, the unseparated non-azeotropic mixture of refrigerants consists of components, the boiling points of many of which are lower than those of components of the separated non-azeotropic mixture of refrigerants. Therefore, in this case, the non-azeotropic mixture of refrigerants is condensed by the condenser 24 at a lower boiling point. That is, the apparatus has a high heating performance.

In the second embodiment, the discharge pipe of the first compressor 21 is connected with the fractionating-/separating device 22 at the middle portion thereof, however, may be connected therewith at any position between the top portion and the bottom portion thereof. Further, any means may be used as the heating source of the heat exchanger 33 and the cooling source of the cooling device 34 provided that the means accelerates the separation of the azeotropic mixture of refrigerants into the low-boiling point refrigerant and the high-boiling point refrigerant by means of the two-phase refrigerant supplied from the first compressor 21. The above description is made on the principle of the refrigerant cycling apparatus which performs the above operation. Needless to say, the apparatus can be applied as a means for air-conditioning or supplying hot-water or a means for providing an extremely low temperature.

As described above, although a heat exchanger is previously required to be provided in the intermediate portion like the conventional refrigerant cycling apparatus comprising a plurality of refrigerant cycling devices, the heat exchanger is not required in the second embodiment. The refrigerant can be separated into the high-boiling point refrigerant circulating through the second refrigerating cycle and the non-azeotropic mixture of refrigerants circulating through the first refrigerating cycle. The non-azeotropic mixture of refrigerants circulating through the first refrigerating cycle consists of components, the boiling points of many of which are lower than those of the refrigerant circulating through the second refrigerating cycle. The discharge pressure of the first compressor 21 and the suction pressure of the second compressor 23 are approximately equal to each other with the non-azeotropic mixture of refrigerants introduced into the second compressor 23 and discharged therefrom at a low temperature. Thus, the apparatus is operated at a high efficiency with the compression ratios of the first compressor 21 and the second compressor 23 reduced. Therefore, a high temperature can be provided by making the vapor pressure low in the condenser 24 positioned in the second refrigerating cycle and a low temperature can be provided without producing a negative pressure in the evaporator 27 positioned in the first refrigerating cycle. The component of the separated refrigerant and the vapor pressure in the condenser 24 produced after the separation is made are selected by the combination and proportion of the components of the non-azeotropic mixture of refrigerants enclosed in the apparatus and the set pressure of the main pressure reducing device 26, the second pressure reducing device 29, and the first pressure reducing device 31. The refrigerating cycle of the apparatus is constructed so that the pressure necessary for the separation of the non-azeotropic mixture of refrigerants into the low-boiling point refrigerant and the high-boiling point refrigerant in the fractionating/separating device 22 is approximately equal to the discharge pressure of the first compressor 21 as well as the suction pressure of the second compressor 23. Thus, the above-described advantage of the first embodiment can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A refrigerant cycling apparatus, enclosing a non-azeotropic mixture comprising a high-boiling point refrigerant and a low-boiling point refrigerant. comprising:

a first compressor:

a second compressor, a suction pipe of which is connected with a discharge pipe of the first compressor;

a fractionating/separating device, the discharge pipe of the first compressor being connected with one of a top portion and a middle portion of the fractionating/separating device, the suction pipe of the first compressor being connected with the top portion of the fractionating/separating device, the discharge pipe of the second compressor being connected with one of the middle portion and a bottom portion of the fractionating/separating device, the suction pipe of the second compressor being connected with the bottom portion of the fractionating/separating device;

a first pressure reducing device provided between the top portion of the fractionating/separating device and the suction pipe of the first compressor;

a first vaporizing means provided between the first pressure reducing device and the suction pipe of the first compressor to vaporize the refrigerant;

a second pressure reducing device provided between the discharge pipe of the second compressor and the fractionating/separating device; and a first condensing means provided between the second pressure reducing device and the suction pipe of the second compressor to condense the refrigerant.

2. The refrigerant cycling apparatus as claimed in claim 1, wherein the first vaporizing means is an evaporator and the first condensing means is a condenser.

3. The refrigerant cycling apparatus as claimed in claim 1, further comprising: a second vaporizing means provided between the discharge pipe of the first compressor and the fractionating/separating device to vaporize the refrigerant; and a second condensing means provided between the suction pipe of the second compressor and the fractionating/separating device to condense the refrigerant.

4. The refrigerant cycling apparatus as claimed in claim 1, wherein the bottom portion of the fractionating/separating device is connected with the suction pipe of the second compressor on the downstream side of a confluence point of the discharge pipe of the first compressor where the discharge pipe of the first compressor is connected with the fractionating/separating device.

5. The refrigerant cycling apparatus as defined in claim 4, further comprising electromagnetic valves provided on a circuit bypassing the discharge pipe of the first compressor and connected with the fractionating-/separating device and on a circuit connecting the bottom portion of the fractionating/separating device and the suction pipe of the second compressor with each other on the downstream side of the discharge pipe of-the first compressor.

6. The refrigerant cycling apparatus as claimed in claim 4, further comprising:

a second vaporizing means provided between the discharge pipe of the first compressor and the fractionating/separating device to vaporize the refrigerant;

a second condensing means provided between the suction pipe of the second compressor and the fractionating/separating device to condense the refrigerant; and a third condensing means provided between the top portion of the fractionating/separating device and the first pressure reducing device to condense the refrigerant.

7. The refrigerant cycling apparatus as claimed in claim 1, wherein an outlet pipe of the first condensing means is bypassed so that the first condensing means is connected with a line connected between the first pressure reducing device and the first vaporizing means through a main pressure reducing means.

8. The refrigerant cycling apparatus as defined in claim 7, wherein one of the first pressure reducing device and the second pressure reducing device is shut off in a circuit bypassing the outlet pipe of the condensing means and connected with the bottom portion of the fractionating/separating device via the second pressure reducing device and a circuit connecting the top portion of the fractionating/separating device and the outlet pipe of the main pressure reducing device with each other via the first pressure reducing device.

9. The refrigerant cycling apparatus as claimed in claim 7, further comprising:

a second vaporizing means provided between the discharge pipe of the first compressor and the fractionating/separating device to vaporize the refrigerant:

a second condensing means provided between the suction pipe of the second compressor and the fractionating/separating device to condense the refrigerant; and a third condensing means provided between the top portion of the fractionating/separating device and the first pressure reducing device to condense the refrigerant.

* * * * *